United States Patent [19]

Hayashi et al.

[11] Patent Number: 4,904,636

[45] Date of Patent: Feb. 27, 1990

[54] HEAT-SENSITIVE RECORDING MATERIAL

[75] Inventors: Hiroo Hayashi; Toshimitsu Arikawa, both of Hyogo, Japan

[73] Assignee: Kanzaki Paper Mfg. Co., Ltd., Tokyo, Japan

[21] Appl. No.: 169,503

[22] Filed: Mar. 17, 1988

[30] Foreign Application Priority Data

Mar. 18, 1987 [JP] Japan ..... 62-67550

[51] Int. Cl.[4] ..... B41M 5/18

[52] U.S. Cl. ..... 503/207; 427/150; 427/151; 428/206; 428/328; 428/913; 503/200; 503/226

[58] Field of Search ..... 503/207, 200, 226; 427/150–152; 428/207, 328, 913, 206

[56] References Cited

U.S. PATENT DOCUMENTS 4,373,013 2/1983 Yoshizumi ..... 428/403

FOREIGN PATENT DOCUMENTS

| | | | |
|---|---|---|---|
| 0116313 | 8/1984 | European Pat. Off. | 503/200 |
| 0179492 | 4/1986 | European Pat. Off. | 503/226 |
| 0238709 | 9/1987 | European Pat. Off. | 503/214 |
| 148687/82 | 3/1981 | Japan . | |
| 156292/82 | 3/1981 | Japan . | |
| 170794/82 | 4/1981 | Japan . | |
| 199687/82 | 6/1981 | Japan . | |

*Primary Examiner*—Bruce H. Hess

*Attorney, Agent, or Firm*—Finnegan, Henderson, Farabow, Garrett and Dunner

[57] ABSTRACT

A heat-sensitive recording material comprising a support and a recording layer provided on the support, said recording layer containing a colorless or pale-colored basic dye and a color developer capable of forming a color upon application of heat, wherein electroconductive titanium oxide is incorporated in at least one of layers constituting the recording material.

2 Claims, No Drawings

HEAT-SENSITIVE RECORDING MATERIAL

FIELD OF THE INVENTION

The present invention relates to a heat-sensitive recording material and more particularly to a heat-sensitive recording material with which recording can be performed always stably without being influenced by external circumstances such as humidity and recording conditions such as recording speed.

BACKGROUND OF THE INVENTION

A heat-sensitive recording material utilizing a coloring reaction between a colorless or pale-colored basic dye and an organic or inorganic color developer by contacting the dye and the color developer through application of heat is well known. A heat-sensitive recording material of this type is widely used, for example, in a facsimile, a printer and as a recording medium for use in various calculators, because it is relatively inexpensive, a recording equipment containing it is compact and further is relatively easy to maintain.

With extention of the application form, a heat-sensitive recording material is used under various conditions that the external circumstances are varied. Thus it is required for the heat-sensitive recording material to have excellent recording suitability so that a recording image can be obtained always stably. For this reason, various improvements have been proposed.

For example, when recording is performed under low humidity conditions, the friction between a recording equipment and a recording paper produces frictional charge, thereby decreasing the passing suitability of the recording paper and causing troubles such as paper plugging (jamming), sticking of the recording paper to the recording equipment, and break-down and abnormal or wrong operation of a thermal-head and other circuits. Therefore, a method of treating the recording material with various electroconductive substances such as metal oxides, metal halides, polymeric electrolytes, surfactants and hygroscopic substances is disclosed in, for example, Japanese Patent Application (OPI) Nos. 148687/82, 156292/82, 170794/82 and 199687/82. (The term "OPI" as used herein means a "published unexamined application".) In accordance with this method, a considerably high improvement can be obtained.

In recent years, in order to obtain a heat-sensitive recording material excellent in a degree of resolution, a film or synthetic paper has been increasingly used as a support. When such a support is used, even if various electroconductive substances as described above are used, satisfactory results cannot be always obtained. Thus still more improvements have been desired.

That is, when a film or synthetic paper is used as a support, in particular, frictional charging under low humidity conditions is marked as compared with the case that the ordinary paper is used as a support. Thus even if electroconductive substances as described above are used, no satisfactory charge-preventing effect can be obtained. It may be considered to use a metal-based electroconductive agent having a high electroconductivity, such as Cu, Ni, Fe, or Al powder. However, such a metal-based electroconductive agent causes marked coloration, as a result of which the commercial value of the resulting heat-sensitive recording material is decreased. If a large amount of electroconductive substance as described above is used in order to increase the electroconductivity, problems are produced in that undesirable fogging is produced in a recording material and blocking between recording materials under high humidity conditions is caused, although the electroconductivity is increased to some extent.

SUMMARY OF THE INVENTION

As a result of investigations to overcome the above problems, it has been found that if electroconductive titanium oxide is chosen from various electroconductive substances and incorporated in a heat-sensitive recording material, stable recording is realized without being influenced by external circumstances from low humidity to high humidity and without being accompanied by the fog phenomenon and the blocking phenomenon even at high speed recording, and furthermore the whiteness of a recording material is high and thus there can be obtained a heat-sensitive recording material of high commercial value. Based on these findings, the present invention has been accomplished.

The present invention relates to a heat-sensitive recording material comprising a support and a recording layer containing a colorless or pale-colored basic dye and a color developer capable of forming a color upon oxide is incorporated in at least one of layers constituting the recording material.

DETAILED DESCRIPTION OF THE INVENTION

In the heat-sensitive recording material of the present invention, as described above, electroconductive titanium oxide is incorporated in at least one of layers constituting the recording material. As the electroconductive titanium oxide, electroconductive titanium oxide obtained by treating the surface of fine titanium oxide powder with fine granular tin oxide and antimony oxide is preferably used.

Such an electroconductive titanium oxide can be produced, for example, by a method in which a solution of antimony chloride and tin chloride in an alcohol, acetone or hydrochloric acid is added to a suspension of spherical or needle-like titanium oxide fine powder to hydrolyze antimony chloride and tin chloride on the surface of titanium oxide powder and, if necessary, calcination treatment is applied.

In the heat-sensitive recording material of the present invention, electroconductive titanium oxide is incorporated in at least one of a recording layer and a support layer basically constituting the recording material and an overcoat layer, an intermediate layer, the back layer of the support, etc. as provided if necessary. It is particularly effective that electroconductive titanium oxide is incorporated in the back layer of the support. Particularly when a film or synthetic paper is used as a support, it is desirable that electroconductive titanium oxide be incorporated in the back layer of the support.

The amount of the electroconductive titanium oxide used is determined appropriately depending on the type of the support, the constitution of the recording layer and further depending on the state of the layer in which the electroconductive titanium oxide is to be incorporated and so forth. Thus it is not critical. In general, the electroconductive titanium oxide is incorporated in an amount of 0.1 to 5 $g/m^2$ and more preferably 0.2 to 2 $g/m^2$.

As the basic dye to be incorporated in the recording layer of the present invention, various known colorless or pale-colored basic dyes can be used. Examples are triarylmethane-based dyes such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis-(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide and the like, diphenylmethane-based dyes such as 4,4'-bisdimethylaminobenzhydryl-benzylether, N-halophenyl-leucoauramines, N-2,4,5-trichlorophenylleucoauramine and the like, thiazine-based dyes such as benzoyl-leucomethyleneblue, p-nitrobenzoyl-leucomethyleneblue and the like, spiro-based dyes such as 3-methylspiro-dinaphthopyran, 3-ethyl-spiro-dinaphthopyran, 3-phenyl-spiro-dinaphthopyran, 3-benzyl-spiro-dinaphthopyran, 3-methylnaphtho(6'-methoxybenzo)-spiro-pyran, 3-propyl-spiro-dibenzopyran and the like, lactam-based dyes such as rhodamine-B-anilinolactam, rhodamine(p-nitroanilino)lactam, rhodamine(o-chloroanilino)lactam and the like, and fluoran-based dyes such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)-fluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran,3-(N-ethyl-p-toluidino)-6-methyl-7-(p-toluidino) fluoran, 3-diethylamino-6-methyl-7-phenylaminofluoran, 3-diethylamino-7-(2-carbomethoxyphenylamino)fluoran, 3-(N-cyclohexyl-N-methylamino)-6-methyl-7-phenylaminofluoran, 3-pyrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-diethylamino-7-(o-fluorophenylamino)fluoran, 3-dibutylamino-7-(o-fluorophenylamino)fluoran, 3-(N-methyl-N-n-amyl)amino-6-methyl-7-phenylaminofluoran, 3-(N-ethyl-N-n-amyl-)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-β-ethylhexyl-)amino-6-methyl-7-phenylaminofluoran and the like. These basic dyes can be used as mixtures of two or more thereof if necessary.

As the color developer, inorganic or organic acidic substances forming a color on contacting with the above basic dyes can be used. Examples are phenolic compounds such as 4-tert-butylphenol, α-naphthol, β-naphthol, 4-acetylphenol, 4-phenylphenol, hydroquinone, 4,4'-isopropylidenediphenol (bisphenol A), 2,2'-methylenebis(4-chlorophenol), 4,4'-cyclohexylidenediphenol, 1,3-di[2-(4-hydroxyphenyl)-2-propyl]benzene, 4,4'-dihydroxydiphenyl sulfide, bis(3-allyl-4-hydroxyphenyl)sulfone, 4-hydroxyphenyl-4'-isopropyloxyphenylsulfone, hydroquinone monobenzylether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenethyl 4-hydroxybenzoate, benzyl 4-hydroxybenzoate, tolyl 4-hydroxybenzoate, chlorphenyl 4-hydroxybenzoate, phenylpropyl 4-hydroxybenzoate, phenyl 4-hydroxybenzoate, p-chlorobenzyl 4-hydroxybenzoate, p-methoxybenzyl 4-hydroxybenzoate, novolak type phenol resins, phenol polymers and the like, aromatic carboxylic acids such as benzoic acid, p-tert-butylbenzoic acid, trichlorobenzoic acid, terephthalic acid, 3-sec-butyl-4-hydroxybenzoic acid, 3-cycylohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid, 3,5-di-α-methylbenzylsalicylic acid and the like, and organic substances such as polyvalent metal (e.g., zinc, magnesium, aluminum, calcium, titanium, manganese, tin and nickel) salts of the above phenolic compounds or aromatic carboxylic acids. These color developers can also be used as mixtures of two or more thereof if necessary.

The ratio of the basic dye to the color developer is not critical and can be determined appropriately depending on the type of the basic dye or color developer. In general, the color developer is used in an amount of 1 to 20 parts by weight, preferably 2 to 10 parts by weight, per part by weight of the basic dye.

A coating composition containing the above substances is prepared, for example, by dispersing the dye and the color developer, in combination with each other or independently, in water as a dispersant by the use of, e.g., a ball mill, an attritor, a sand mill or the like.

In the coating composition, usually as a binder, starches, hydroxyethyl cellulose, methyl cellulose, carboxymethyl cellulose, gelatin, casein, gum arabic, polyvinyl alcohol, acetoacetyl group-modified polyvinyl alcohol, diisobutylene-maleic anhydride copolymer salts, styrene-maleic anhydride copolymer salts, ethylene-acrylic acid copolymer salts, styrene-acrylic acid copolymer salts, styrene-butadiene copolymer emulsions, a urea resin, a melamine resin, an amide resin and the like are used in a proportion of 2 to 40% by weight, preferably 5 to 25% by weight, based on the total weight of solids.

To the coating composition, if necessary, various aids can be added. For example, dispersing agents such as sodium dioctylsulfosuccinate, sodium dodecylbenzenesulfonate, sodium salts of lauryl alcohol sulfuric acid esters, fatty acid metal salts and the like, ultraviolet absorbing agents such as benzophenone-based compounds and the like, and other defoaming agents, fluorescent dyes, coloring dyes and the like can be added appropriately.

In addition, if necessary, zinc stearate, calcium stearate, waxes such as polyethylene wax, carnauba wax, paraffin wax, ester wax and the like, fatty acid amides such as stearic acid amide, stearic acid methylenebisamide, oleic acid amide, palmitic acid amide, coconut fatty acid amide and the like, hindered phenols such as 2,2'-methylene-bis(4-methyl-6-tert-butylphenol), 1,1,3-tris(2-methyl-4-hydroxy-5-tert-butylphenyl) butane and the like, ultraviolet absorbing agents such as 2-(2'-hydroxy-5'-methylphenyl)benzotriazole, 2-hydroxy-4-benzyloxybenzophenone and the like, esters such as 1,2-di(3-methylphenoxy)ethane, 1,2-diphenoxyethane, 1-phenoxy-2-(4-methylphenoxy)ethane, 1,4 dimethoxynaphthalene, 1,4-diethoxynaphthalene and the like, esters such as dimethyl terephthalate, dibutyl terephthalate, dibenzyl terephthalate, phenyl 1-hydroxy-2-naphthoate and the like, biphenyls such as p-benzylbiphenyl and the like, various known heat fusible substances, inorganic pigments such as kaolin, clay, talc, calcium carbonate, calcined clay, titanium oxide, diatomaceous earth, fine granular anhydrous silica, activated clay and the like can be added.

Moreover, usual electroconductive substances can be added within the range that does not deteriorate the desired effects of the present invention.

In the heat-sensitive recording material of the present invention, a method of forming a recording layer is not critical. For example, the recording layer is formed by coating the coating composition by techniques such as air knife coating and blade coating. The amount of the coating composition coated is not critical. Usually the amount of the coating composition coated is controlled within the range of about 2 to 12 g/m$^2$, preferably about 3 to 10 g/m$^2$ (as dry weight).

On the recording layer can be provided an overcoat layer for the purpose of, e.g., protecting the recording layer. If necessary, a protective layer can be provided on the back surface of the support. In addition, various known techniques in the field of preparation of heat-sensitive recording materials, such as providing a subbing layer or intermediate layer on the support, applying an adhesive treatment to the back side of the recording material, and fabricating into adhesive labels can be applied if necessary.

In the heat-sensitive recording material of the present invention, electroconductive titanium oxide is incorporated in at least one of the aforementioned layers constituting the recording material. Electroconductive titanium oxide may be mixed with a suitable binder to prepare a coating composition which is then coated to form a coating layer. To this coating composition, if necessary, suitable aids such as inorganic pigments, dyes, water resistant agents and the like can be added.

The present invention is described in greater detail with reference to the following examples. All parts and percents (%) are by weight unless otherwise indicated.

EXAMPLE 1

(1) Preparation of Dispersion A

| | |
|---|---|
| 3-(N—Ethyl-N—isoamylamino)-6-methyl-7-phenylaminofluoran | 10 parts |
| Dibenzyl terephthalate | 20 parts |
| 5% Aqueous solution of methyl cellulose | 20 parts |
| Water | 40 parts |

This composition was ground by the use of a sand mill to an average particle diameter of 3 μm.

(2) Preparation of Dispersion B

| | |
|---|---|
| 4,4'-Isopropylidenediphenol | 30 parts |
| 5% Aqueous solution of methyl cellulose | 40 parts |
| Water | 20 parts |

This composition was ground by the use of a sand mill to an average particle diameter of 3 μm.

(3) Formation of Recording Layer 90 parts of Dispersion A, 90 parts of Dispersion B, 30 parts of fine granular anhydrous silica (trade name: Mizukasil® P-527, average particle diameter: 1.8 μm, oil absorption amount: 180 ml/100 g, manufactured by Mizusawa Kagaku Co., Ltd.), 300 parts of a 10% aqueous polyvinyl alcohol solution and 28 parts of water were mixed and stirred to obtain a coating composition. The coating composition thus obtained was coated on a synthetic paper (trade name: Yupo® FPG manufactured by Oji-Yuka Synthetic Paper Co., Ltd.) in such an amount that the coated amount after drying was 5 g/m$^2$ and dried and, thereafter, was subjected to super-calendering to obtain a heat-sensitive recording material.

(4) Formation of Back Layer

| | |
|---|---|
| Electroconductive titanium oxide obtained by treating the surface of fine titanium oxide powder with fine granular tin oxide and antimony oxide (white electroconductive titanium oxide "600W" manufactured by Ishihara Sangyo Kaisha, Ltd., particle shape: spherical) | 8 parts |
| 15% Aqueous solution of polyvinyl alcohol | 14 parts |
| Water | 10 parts |

This composition was mixed and stirred to obtain a coating composition. This coating composition was coated on the back surface of the support in such an amount that the coated amount after drying was 2.5 g/m$^2$ and then dried to obtain a heat-sensitive recording material of the present invention.

EXAMPLE 2

A heat-sensitive recording material was produced in the same manner as in Example 1 except that in the formation of the back layer, electroconductive titanium oxide obtained by treating the surface of fine titanium oxide powder with fine granular tin oxide and antimony oxide (white electroconductive titanium oxide "500W" manufactured by Ishihara Sangyo Kaisha, Ltd., particle shape: spherical) was used in place of the electroconductive titanium oxide (white electroconductive titanium oxide "600W" manufactured by Ishihara Sangyo Kaisha, Ltd).

EXAMPLE 3

A heat-sensitive recording material was produced in the same manner as in Example 1 except that in the formation of the back layer, electroconductive titanium oxide obtained by treating the surface of fine titanium oxide powder with fine granular tin oxide and antimony oxide (needle-like electroconductive titanium oxide "FT-1000" manufactured by Ishihara Sangyo Kaisha, Ltd., particle shape: needle-like) was used in place of the electroconductive titanium oxide (white electroconductive titanium oxide "600W" manufactured by Ishihara Sangyo Kaisha, Ltd.).

EXAMPLE 4

To 90 parts of Dispersion A and 90 parts of Dispersion B as obtained in a similar manner to that in Example 1, 30 parts of electroconductive titanium oxide (white electroconductive titanium oxide "600W" manufactured by Ishihara Sangyo Kaisha, Ltd.), 200 parts of a 15% oxidized starch aqueous solution and 14 parts of water were added and stirred to obtain a coating composition. This coating composition was coated on a base paper having a basis weight of 50 g/m$^2$ in such an amount that the coated amount after drying was 6 g/m$^2$ and dried and, thereafter, was subjected to supercalendering to obtain a heat-sensitive recording paper.

COMPARATIVE EXAMPLES 1 AND 2

Heat-sensitive recording materials were produced in the same manner as in Example 1 except that in the formation of the back layer, electroconductive zinc oxide (electroconductive zinc oxide "23-K" manufactured by Hakusui Kagaku Co., Ltd.) (Comparative Example 1) and an anionic polymer electroconductive agent (Comparative Example 2) were used in place of the electroconductive titanium oxide (white electroconductive titanium oxide "600W" manufactured by Ishihara Sangyo Kaisha, Ltd.).

The six heat-sensitive recording materials thus obtained were tested by the methods described below. The results are shown in Table 1.

(Measurement of Surface Resistance)

The surface resistance of the back layer of the recording material was measured under both ordinary humidity (20° C., 60% RH) and low humidity (20° C., 20% RH) conditions by the use of a teraohmmeter (Model VE-30 manufactured by Kawaguchi Denki Co., Ltd.). The results are shown in Table 1.

(Recording suitability)

Suitability for passing and discharging sheet was evaluated by recording under both ordinary humidity and low humidity conditions by the use of a video printer (SCT-P-60 manufactured by Mitsubishi Electric Corporation), and the recording density of the recorded image was measured with a Macbeth densitometer (Model RD-914 of Macbeth Corp.). The results are shown in Table 1. The rating for evaluation of suitability for passing and discharging sheet was as follows:

O: No trouble in passing and discharging sheet due to frictional charging

×: Sticking of the recording material to the video printer is caused by frictional charging.

TABLE 1

| Run No. | Surface Resistance (Ω) | | Recording Density | | Passing/Discharging Sheet | |
|---|---|---|---|---|---|---|
| | Ordinary Humidity | Low Humidity | Ordinary Humidity | Low Humidity | Ordinary Humidity | Low Humidity |
| Example 1 | $3.7 \times 10^5$ | $2.8 \times 10^5$ | 1.25 | 1.24 | O | O |
| Example 2 | $2.8 \times 10^6$ | $3.7 \times 10^6$ | 1.25 | 1.25 | O | O |
| Example 3 | $7.2 \times 10^5$ | $8.1 \times 10^5$ | 1.25 | 1.25 | O | O |
| Example 4 | $6.0 \times 10^8$ | $2.2 \times 10^9$ | 1.19 | 1.20 | O | O |
| Comparative Example 1 | $1.1 \times 10^{12}$ | $\geqq 10^{13}$ | 1.25 | 1.25 | X | X |
| Comparative Example 2 | $9.4 \times 10^6$ | $1.3 \times 10^{10}$ | 1.24 | 1.24 | O | X |

Ordinary humidity: 20° C., 60% RH
Low humidity: 20° C., 20% RH

As apparent from the results of Table 1, all the recording materials of the present invention were not influenced by changes in external circumstances and had stable recording suitability.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support and a recording layer provided on the support, said recording layer containing a colorless or pale-colored basic dye and a color developer capable of forming a color upon application of heat and said support containing a back surface layer, wherein electroconductive titanium oxide prepared by treating the surface of fine titanium oxide powder with fine granular tin oxide and antimony oxide is incorporated in one of said recording layer and said back surface layer of said support.

2. The recording material as claimed in claim 1, wherein the support is a film or a synthetic paper.

* * * * *